United States Patent [19]

Kwasnik et al.

[11] Patent Number: 4,515,660

[45] Date of Patent: May 7, 1985

[54] APPARATUS FOR REMOVING CHARGING HOLE COVERS AND FOR CLEANING SEALING SURFACES IN A COKE OVEN

[75] Inventors: Hans-Jurgen Kwasnik, Herne; Hans-Gunter Piduch; Heinz-Dieter Bruske, both of Bochum, all of Fed. Rep. of Germany

[73] Assignee: C. Otto & Comp. G.m.b.H., Bochum, Fed. Rep. of Germany

[21] Appl. No.: 606,234

[22] Filed: May 2, 1984

[30] Foreign Application Priority Data

May 9, 1983 [DE] Fed. Rep. of Germany ..... 3316936

[51] Int. Cl.[3] ..... C10B 25/20

[52] U.S. Cl. ..... 202/241; 15/21 R; 201/2; 202/251; 414/164; 414/684.3

[58] Field of Search ..... 202/241, 251; 201/2; 15/93 A, 21 R; 414/164, 684.3

[56] References Cited

U.S. PATENT DOCUMENTS

| | | | |
|---|---|---|---|
| 3,419,163 | 12/1968 | Kostochka | 414/164 |
| 3,689,369 | 9/1972 | Tucker | 202/251 |
| 3,709,387 | 1/1973 | Kinzler et al. | 202/251 |
| 3,753,502 | 8/1973 | Abendroth | 202/251 |
| 4,321,112 | 3/1982 | Galow et al. | 414/164 |

FOREIGN PATENT DOCUMENTS

| | | | |
|---|---|---|---|
| 2536049 | 3/1976 | Fed. Rep. of Germany | 202/241 |
| 2448043 | 4/1976 | Fed. Rep. of Germany | 202/241 |

*Primary Examiner*—Jay H. Woo
*Assistant Examiner*—Mike McGurk
*Attorney, Agent, or Firm*—Thomas H. Murray; Clifford A. Poff

[57] ABSTRACT

Apparatus for removing charging hole covers and for cleaning sealing surfaces is carried by a charging car that is movable along an oven roof of a battery of horizontal coke oven chambers. The apparatus includes a support member carried by guides for vertical movement on the charging car. A pivot head is carried by a shaft to pivot about a first axis on the support member. The first axis is inclined at an angle of 45° to vertical. A magnetic gripper is carried by a shaft to rotate about a second axis on the pivot head. A charging hole frame cleaner includes a cleaning tool carried by a shaft to rotate about a third axis on the pivot head. The second and third axes are disposed in a plane at an angle to one another on opposite sides of the first axis and coplanar with the first axis. The parts are arranged such that the pivot head simultaneously positions a charging hole cover while carried by the gripper in alignment with a cleaner for sealing surfaces on the cover while a cleaner for the charging hole frame and charging hole is aligned for cleaning the sealing surfaces and the charging hole.

7 Claims, 5 Drawing Figures

APPARATUS FOR REMOVING CHARGING HOLE COVERS AND FOR CLEANING SEALING SURFACES IN A COKE OVEN

BACKGROUND OF THE INVENTION

This invention relates to an apparatus carried for vertical movements on a charging car including a rotatable gripper for removing and fitting charging hole covers for a horizontal coke oven chamber and further including a charging hole frame cleaner with a rotatable cleaning tool movable from a remote position to an operative position for cleaning sealing surfaces incident to charging coal into the oven chamber.

It is known in the art to provide a device for mechanically opening, cleaning and closing charging holes located in the ovens roof for introducing coal into the coking chambers of a horizontal coke oven battery. One form of such a device is disclosed in West Germany patent publication No. 30 16 418 which embodies a relatively complex construction; and accordingly, requires an excessive amount of space for the installation and operation of the device. The device is constructed to traverse along a support frame above the oven roof independently of a coal-charging car and other devices. Not only does the device occupy extra free space but also blocks access routes above the oven roof. The installation of extrasensitive machinery and devices in this area is a considerable disadvantage to practical operation of the coke oven battery, particularly due to the need for rapid access for maintenance and repair work and the risk involved to workmen in the highly-heated environment.

SUMMARY OF THE INVENTION

It is an object of the present invention to provide an apparatus designed to reduce to simple movements the individual functions such as lifting and fitting of charging hole covers as well cleaning of the sealing surfaces incident to charging coal into an oven chamber so that the operations by the apparatus can be performed in a minimum amount of space by a compact construction of the apparatus and utilization of operationally dependable equipment and components which are arranged in an easily accessible manner for any maintenance and repair work that can be carried out rapidly and without difficulty.

It is a further object of the present invention to provide an apparatus to facilitate lifting and fitting charging hole covers and cleaning sealing surfaces which can be installed on a coal-charging car adapted to traverse a coke oven battery above the oven roof.

More particularly, the present invention provides an apparatus carried by a charging car movable along an oven roof of a battery of horizontal coke oven chambers for removing charging hole covers and for cleaning sealing surfaces, the apparatus including the combination of a support member guided for vertical movement on the charging car, a support head carried by a shaft to pivot about a first axis on the support member, a magnetic gripper carried by a shaft to rotate about a second axis on the support head, and a charging hole frame cleaner including a cleaning tool carried by a shaft to rotate about a third axis on the support head, the first axis bisecting the angle formed between the second and third axes which are disposed in a plane at an angle to one another on opposite sides of the first axis.

Thus, according to the present invention a magnetic gripper and a charging hole frame cleaner are disposed on a pivoting head on opposite sides of the pivot axis with the rotational axes of the gripper and cleaner being disposed at an angle to one another in a coplanar relationship. The pivot axis of the pivot head is disposed in a plane and coincides with the bisector of the angle between the two rotational axes of the gripper and cleaner. The pivoting head is mounted on a carrying member and guided for vertical movement on a vertical guide.

The angle between the two axes of rotation of the gripper and cleaner is preferably 90°. Advantageously, the pivoting head is a crossmember made from a channel section. The magnetic gripper and the charging hole frame cleaner are supported by the outer limbs of the crossmember.

In another aspect of the present invention, a cleaning element is provided for cleaning the sealing surfaces of a charging hole cover. A cleaning element is disposed on a slide adapted to reciprocate in the direction of the rotational axis of the magnetic gripper. The cleaning element is disposed on the carrying member and centered with the gripping element when in its normal position. Drive means for rotating the magnetic gripper and the charging hole frame cleaner may take the form of separate drives or a common drive can be used together with a transmission.

According to another aspect of the present invention, the charging hole frame cleaner is combined with a rotating tool, such as brushes or scrapers, for cleaning the shaft portion of the charging hole. One of the main advantages of the present invention is the provision that the elements, namely the magnetic gripper and the charging hole frame cleaner, are disposed on a common pivoting head whereby the required movements between normal and working positions can be performed by simple rotational movement of the pivoting head. At the same time, the magnetic gripper and the charging hole frame cleaner can be disposed adjacent one another in a restricted amount of space. This produces a compact construction which also has the advantage that a relatively small space is occupied for the working movements of the components.

Another advantage of the present invention is that while the sealing surfaces of the charging hole are cleaned, it is also possible to clean sealing surfaces of the charging hole cover. For this purpose, a further cleaning element is provided on a slide for rectilinear working movements. The slide, together with the pivoting head, are mounted on the same member so that there is no need for additional alignment between the charging hole cover and the cleaning element. The rotatable charging hole frame cleaner may be combined with another tool for cleaning the coal-filling shaft in the oven roof.

These features and advantages of the present invention as well as others will be more fully understood when the following description is read in light of the accompanying drawings, in which.

Figure 1:
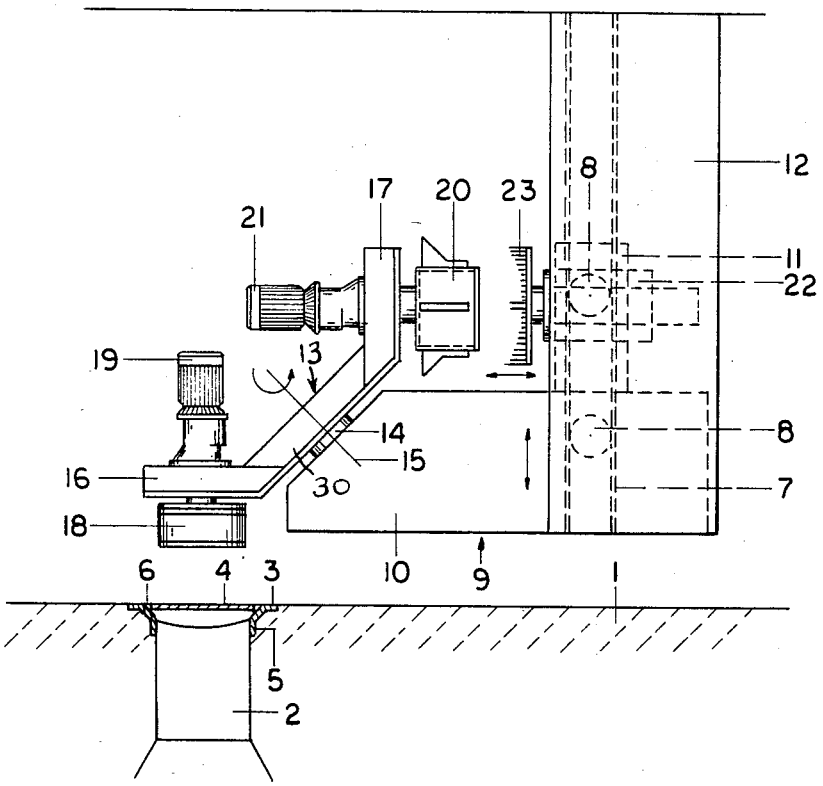
FIG. 1 is a side elevational view of an apparatus according to the present invention shown in a position above a charging hole.
Figure 2:
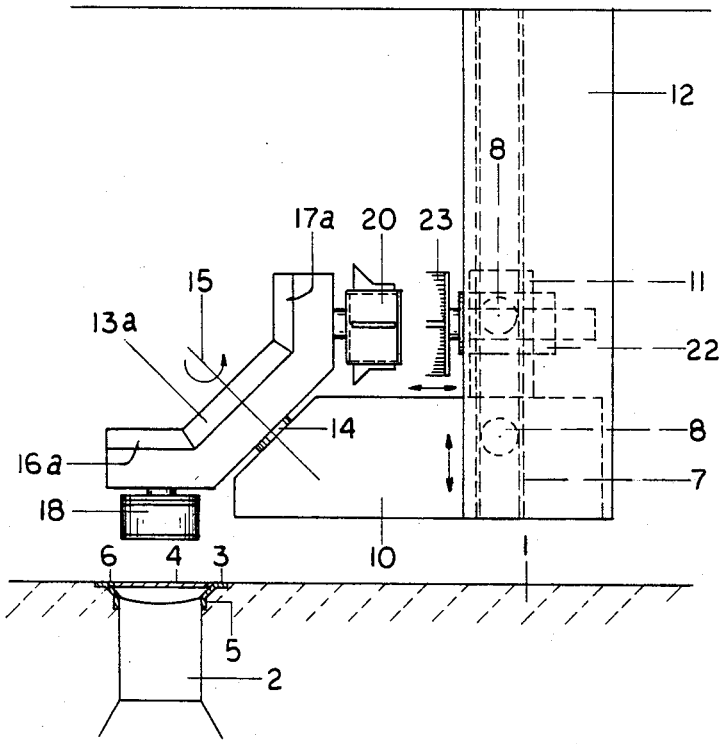
FIG. 2 is a side elevational view of the apparatus illustrated in FIG. 1 but provided with an integrated drive for a magnetic gripper and a charging hole frame cleaner of the apparatus.
Figure 4:
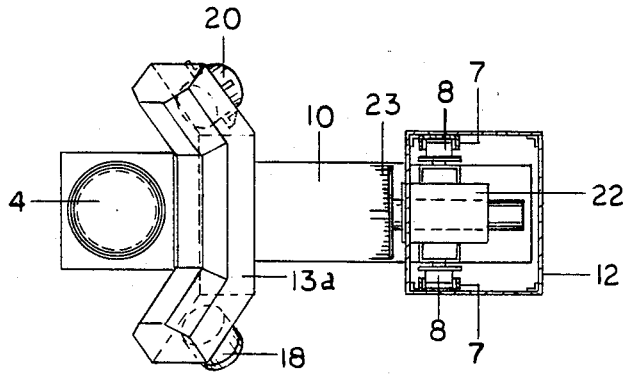
FIG. 4 is a plan view, in section, taken along line IV-IV of FIG. 3.
Figure 3:
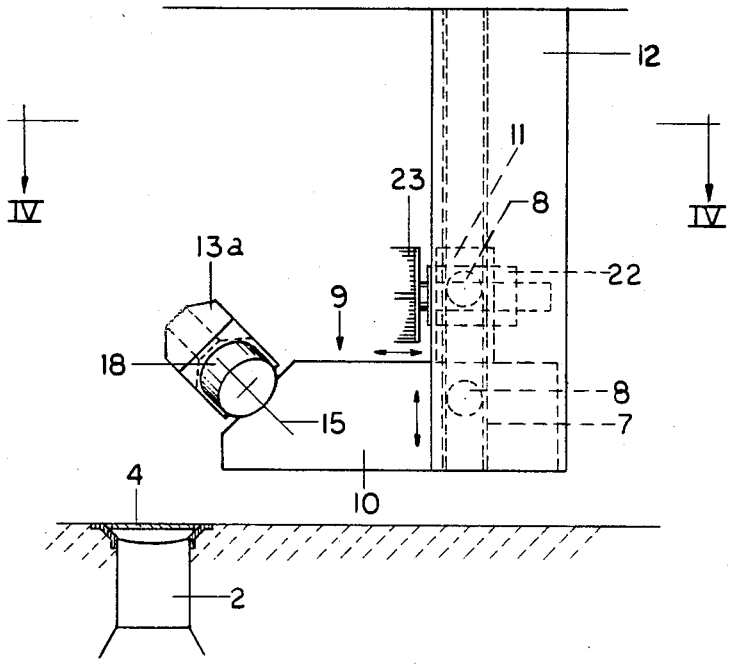
FIG. 3 is a side elevational view of the apparatus shown in FIG. 2 with the pivoting head rotated through an angle of 90°.

In FIGS. 1-3 of the drawings, there is illustrated an oven crown or roof 1 of a battery of horizontal coke oven chambers. The section through the roof is taken along the central plane of a charging hole 2. A circular charging hole frame 3 is arranged at the top of the charginghole 2 in flush relation with the top of the roof. The charging hole frame 3 used to mount a charging hole cover 4 and between which there is a sealing surface 5 on the frame and a corresponding sealing surface 6 on the cover 4. The sealing surfaces 5 and 6 are in the form of conical surfaces.

A charging car, not shown, is adapted in any suitable well-known manner to traverse longitudinally along the coke oven battery above the roof 1 on rails. During charging of coal into an oven chamber, the charging car is positioned so that coal can flow from a charging hopper into an open charging hole therebeneath. The charging hole cover is lifted and subsequently mechanically fitted by means of apparatus embodying the features of the present invention.

The apparatus for lifting charging hole covers is guided for vertical movement on a vertical support frame, the top end of which is rigidly secured to the frame structure of the charging car. The carrying frame includes two U-shaped sections 7 which are disposed with their open sides facing one another. Limbs of the sections 7 form guide rails for rollers 8 of a support assembly 9. The support assembly includes a horizontally-arranged main member 10 having a rear portion that extends into the space between the U-shaped sections 7 and an attachment member 11 situated above the main horizontal member 10. There are four rollers 8 of which one pair of rollers is rotatably mounted on the main horizontal member 10 and the second pair of rollers is rotatably mounted on attachment member 11. Each of the rollers 8 is rotatable about a horizontal axis. The support assembly 9 is lifted and lowered by a drive, not shown, consisting of a hydraulically- or pneumatically-operated actuating cylinder or an electric motor connected with a gear drive for producing linear movement.

As shown in FIGS. 1-4, the support assembly 9 is enclosed in a protective casing 12 which abuts against the outside of the U-shaped sections 7. The casing is open on one side for up and down movement of the support assembly 9 with the three remaining sides sealing off the interior of the casing. A pivoting head 13 is mounted at the free end of the main horizontal member 10 which extends in a cantilevered fashion from the U-shaped sections 7. The pivoting head is supported by a pivot shaft 14 projecting from the member 10 and forms a pivot axis 15 which extends in a vertically-transverse plane to the longitudinal axis of the coke oven battery at an inclination angle of 45° to the horizontal. The pivoting head 13 takes the form of a crossmember having an approximately channel-shaped profile with two equal length limbs 16 and 17 rigidly secured at the ends of a central base part 30. The base part is inclined at an angle of 45° so that the two limbs 16 and 17 extend therefrom at right angles to one another. Limb 16 forms a holder for a rotatable magnetic gripper 18, per se, known in the art, for engaging and holding a charging hole cover 4. The magnetic gripper is situated on the outside of limb 16. In FIG. 1, the gripper is driven by a separate drive 19 mounted by a flange on the inside of the limb. The drive includes, for example, an electric motor with an associated reduction gear. A rotatable cleaning tool 20 for cleaning the seat surface of the charging hole frame 3 is mounted to the limb 17 of pivoting head 13. A separate drive 21 is mounted by a flange on the inside of the limb 17 for imparting rotational movement to the cleaning tool 20.

As shown in FIGS. 1-4, a horizontal slide 22 is disposed in attachment member 11 for traversing movement. A cleaning tool 23 is disposed on the side of the slide 22 facing the pivoting head 13 and may, for example, take the form of brushes or mechanical scrapers for cleaning the sealing surface of the cover 4. During the cleaning operations, the cover is rotated by the drive 19 and the cleaning tool 23 is pressed by the slide 22 against the sealing surface of a cover for cleaning. For this operation, the pivoting head 13 is pivoted into a cleaning position to position the cover 4 removed from a charging hole into an aligned confronting relation with the cleaning tool 23.

In FIGS. 2 and 3, there is illustrated an embodiment of the present invention which differs from that already described with respect to the drives for the magnetic gripper 18 and the drive for charging hole frame cleaner 20. In other respects, the description given above applies with equal effect and the same reference numerals have been applied to identical parts. As shown in FIG. 2, the magnetic gripper 18 and the charging hole frame cleaner 20 are connected to a central drive 13*a* by gear elements 16*a* and 17*a*, respectively, through a transmission situated inside the pivoting head 13*a*. The drive may be entirely disposed in the pivoting head or include parts extending into the carrying member 9.

Figure 5:
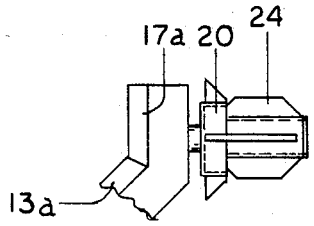
FIG. 5 is an enlarged view illustrating the details of a charging hole frame cleaner combined with a tool for cleaning a filling shaft.

The charging coal frame cleaner 20 may be equipped with a second cleaning tool as shown in FIG. 5 and identified by reference numberal 24. The second cleaning tool in the form shown in the drawings is a cylindrical brush for cleaning a length of the charging shaft beneath the charging hole frame 3. By the combination of cleaner 20 and tool 24, it is possible to clean the charging hole frame 3 and the charging shaft in one operation.

The apparatus of the present invention is operated by first positioning the apparatus in a cleaning position above a charging hole 2. The support assembly 9 is lowered to lower the magnetic gripper 18 into engagement with a charging hole cover 4. A switch is then actuated to deliver electrical current to the magnet of the magnetic gripper and after the cover is firmly engaged by the gripper, the charging hole cover is rotated by means of drive 19. The support assembly 9 is then moved upwardly and the pivoting head 13, in FIG. 1, or 13*a* in FIGS. 2 and 3, is pivoted about axis 15 of shaft 14 into a position so that the charging hole frame cleaner 20 occupies the position of the magnetic gripper 18 and vice versa. Thereafter, the support assembly is lowered until the charging hole frame cleaner contacts the sealing surface 5 of the charging hole frame 3. At the smae time, the cleaning tool 23 is brought by slide 22 into a position in front of the charging hole cover while carried by the magnetic gripper. The drive 19 of FIG. 1 or drive 13*a* of FIGS. 2 and 3 is operated to rotate the cover for cleaning of the sealing surface thereof by contact with the cleaning tool 23. The cleaning tool is then retracted and the pivoting head 13 or 13*a* is pivoted into the initial position whereupon the charging hole cover 4 is refitted on the charging hole frame and rotated into a closed position by movement of the support assembly 9. The switch for controlling delivery of electrical current to the magnet is then switched OFF and the support assembly 9 is moved upwardly.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. An apparatus carried by a coal-charging car movable along an oven roof of a battery of horizontal coke oven chambers for removing charging hole covers and for cleaning sealing surfaces, said apparatus including the combination of a support member having guide means for vertical movement on a charging car, a support head carried by a shaft to pivot about a first axis on said support member, a magnetic gripper carried by a shaft rotatable about a second axis on said head, and a charging hole frame cleaner including a cleaning tool carried by a shaft to rotate about a third axis on said support head, said first axis bisecting the angle between said second and third axes which are disposed in a plane at an angle to one another on opposite sides of said first axis.

2. The apparatus according to claim 1 wherein the angle between said second and third axes is 90°.

3. The apparatus according to claim 1 wherein said support head includes a support means having a channel-shaped cross section with outer limbs on the ends of the support means for carrying on the outside of the limbs said magnetic gripper and said charging hole frame cleaner.

4. The apparatus according to claim 1 further including a horizontal reciprocating slide means with a charging hole cover cleaning element carried thereby at a position such that when said second axis and related magnetic gripper are rotated about said first axis, a charging hole cover carried by said magnetic gripper confronts said cleaning element.

5. The apparatus according to claim 1 further including a first drive for rotating said magnetic gripper and a second drive for rotating said charging hole frame cleaner.

6. The apparatus according to claim 1 further including a drive coupled by individual gears for rotating said magnetic gripper and said charging hole frame cleaner.

7. The apparatus according to claim 1 wherein said charging hole frame cleaner includes means for cleaning a frame of a charging hole and means for cleaning a charging shaft situated below the charging hole frame in an oven roof.

* * * * *